US007827716B2

(12) United States Patent
Smith

(10) Patent No.: US 7,827,716 B2
(45) Date of Patent: Nov. 9, 2010

(54) MOUNTING FOR SHEET SIGNAGE

(76) Inventor: Marvin A. Smith, 605 S. Douglas St., El Segundo, CA (US) 90245

( * ) Notice: Subject to any disclaimer, the term of this patent is extended or adjusted under 35 U.S.C. 154(b) by 148 days.

(21) Appl. No.: 11/736,413

(22) Filed: Apr. 17, 2007

(65) Prior Publication Data

US 2008/0256834 A1 Oct. 23, 2008

(51) Int. Cl.
*G09F 21/04* (2006.01)

(52) U.S. Cl. ..... 40/590; 40/603

(58) Field of Classification Search ..... 40/590, 40/603, 604; 296/186.1; 160/378; 38/102.3, 38/102.4

See application file for complete search history.

(56) References Cited

U.S. PATENT DOCUMENTS

| | | | | | |
|---|---|---|---|---|---|
| 3,373,464 | A | | 3/1968 | Ausnit | 24/576 |
| 3,788,682 | A | * | 1/1974 | Ehrlich | 296/186.1 |
| 4,103,445 | A | | 8/1978 | Smith et al. | 40/603 |
| 4,393,558 | A | | 7/1983 | Herwegh et al. | 24/459 |
| 4,498,264 | A | * | 2/1985 | McCafferty et al. | 52/281 |
| 4,955,928 | A | | 9/1990 | Tanner | 40/603 |
| 5,042,182 | A | | 8/1991 | King | 40/603 |
| 5,058,299 | A | | 10/1991 | Suzuki | 40/603 |
| 5,245,774 | A | | 9/1993 | Huber | 40/603 |
| 5,301,447 | A | | 4/1994 | Lotter et al. | 40/603 |
| 5,408,784 | A | | 4/1995 | Wruck et al. | 49/489.1 |
| 5,467,546 | A | | 11/1995 | Kovalak, Jr. | 40/603 |
| 5,664,354 | A | | 9/1997 | Daviau et al. | 40/603 |
| 5,685,099 | A | | 11/1997 | Favata | 40/590 |
| 5,893,227 | A | | 4/1999 | Johansson et al. | 40/603 |
| 5,946,869 | A | | 9/1999 | Zinbarg | 52/202 |
| 6,041,535 | A | | 3/2000 | Holloway et al. | 40/603 |
| 6,073,376 | A | | 6/2000 | Verret | 40/603 |
| 6,088,942 | A | | 7/2000 | Brooks et al. | 40/603 |
| 6,092,319 | A | | 7/2000 | Hicks | 40/603 |
| 6,164,364 | A | | 12/2000 | Morris | 160/327 |
| 6,209,245 | B1 | * | 4/2001 | Wittenberg | 40/603 |
| 6,241,305 | B1 | | 6/2001 | Troeger et al. | 296/102 |
| 6,250,002 | B1 | | 6/2001 | Wittenberg | 40/603 |
| 6,257,306 | B1 | | 7/2001 | Weldy | 160/327 |
| 6,276,082 | B1 | | 8/2001 | Richards et al. | 40/603 |
| 6,282,822 | B1 | | 9/2001 | Rinzler et al. | 40/590 |
| 6,289,635 | B1 | | 9/2001 | Procton et al. | 49/467 |
| 6,314,687 | B1 | | 11/2001 | Schondelmayer et al. | 52/63 |
| 6,324,797 | B1 | | 12/2001 | Fago et al. | 52/222 |
| 6,339,889 | B1 | | 1/2002 | Griesemer et al. | 40/603 |

(Continued)

OTHER PUBLICATIONS

TransMedia Brochure, undated.

*Primary Examiner*—Gary C Hoge
(74) *Attorney, Agent, or Firm*—Connolly Bove Lodge & Hutz LLP

(57) ABSTRACT

A mounting for sheet signage which includes a base structure of frame elements, an elongate support having frame members and sheet attachments. Mounts on the base and on the elongate supports facilitate placement of the mounting on the base structure. Interlocking elements are engageable through relative longitudinal displacement between the elongate supports and the base which are neither engageable nor disengageable through relative lateral displacement between these elements. A mounting for sheet signage also contemplates the integration of a vehicle frame with sheet attachments.

9 Claims, 5 Drawing Sheets

U.S. PATENT DOCUMENTS

| | | | | |
|---|---|---|---|---|
| 6,513,272 | B2 | 2/2003 | Richards et al. | 40/603 |
| 6,530,165 | B2 | 3/2003 | Griesemer et al. | 40/603 |
| 6,564,488 | B2 | 5/2003 | Wittenberg | 40/603 |
| 6,684,542 | B2 | 2/2004 | Green, III et al. | 40/603 |
| 6,698,123 | B2 | 3/2004 | Smith | 40/603 |
| 6,758,002 | B1 * | 7/2004 | Duguay | 40/603 |
| 6,782,646 | B1 * | 8/2004 | Devaney | 40/590 |
| 6,782,647 | B2 | 8/2004 | Richards et al. | 40/603 |
| 6,945,300 | B2 | 9/2005 | Smith | 160/89 |
| 2001/0037595 | A1 * | 11/2001 | Palmeri | 40/603 |
| 2002/0093216 | A1 * | 7/2002 | Ananian | 296/100.12 |
| 2002/0194760 | A1 * | 12/2002 | Wittenberg | 40/603 |

* cited by examiner

MOUNTING FOR SHEET SIGNAGE

BACKGROUND OF THE INVENTION

The field of the present invention is mounting systems for the attachment of sheets to structures with the sheets being gripped about their edges.

Systems have been developed for the mounting of sheets under tension to structures. Advertising and other information is often temporarily presented on large sheets which are placed on billboards, truck panels and the like. One form of such sheet material is tensioned vinyl sheet. Such sheet may be printed upon and surrounded by a more rigid plastic border which is RF welded to the sheet. The border typically includes a large bead, circular in cross section, which operates as a tenon in association with a C-shaped mortise associated with a mounting frame. Another border type includes a more structural bead forming a retainer capable of engaging structural elements of the supporting structural frame.

A current system includes a mounting for a sheet that has a bead about its periphery. The system includes frame members forming a rectangle with certain of the frame members having mutually parallel multiple engagement surfaces defined on ribs. As one utility, the frame has been mounted on trucks for advertising. The system further includes elongate retainers having elongate flanges with interlocking surfaces that can selectively interlock with any one of the engagement surfaces on the frame members and retainer mortise elements to receive the tenon beads on the periphery of the sheet. Alternatively, the retainer and the bead are integrated into one mechanism for structural engagement with the frame. The frame also has frame rails having rail surfaces that face away from corresponding retainer rail surfaces on the rails of the retainers. A tool including pinch rollers squeezes the corresponding rail surfaces toward one another to place the sheet material held by the retainer in tension while the interlocking surface is engaged with the appropriate engagement surface.

An advantage of the aforementioned development is the ability to rapidly and securely mount sheets within the mounting system. However, it remains that the initial installation of the devices to support the sheets are not so facilely placed. Consequently, there is need for systems which can be originally mounted or replace with facility.

SUMMARY OF THE INVENTION

The present invention is directed to a mounting for sheet signage or simple coverage. Such signage has a sheet defining a periphery with at least two opposed edges. Elongate supports are arranged to receive opposed edges of the sheet.

In a first separate aspect of the present invention, a base is employed along with elongate supports. The elongate supports include attachments to retain opposed edges of a sheet. A mount on the base and on at least one of the supports includes interlocking elements engageable through relative longitudinal displacement between the support or supports and the base. Neither engagement nor disengagement is available through relative lateral displacement between such components. This enables facile mounting of the elongate supports.

In a second separate aspect of the present invention, a base is employed along with elongate supports. The elongate supports include attachments to retain opposed edges of a sheet. A mount on the base and on at least one of the supports include interlocking elements engageable through relative longitudinal displacement between the support or supports and the base. Neither engagement nor disengagement is available through relative lateral displacement between such components. The mount includes elongate interlocking channel and rail joints. Single or multiple channels and rails may be employed in each joint. Again, this enables facile mounting of the elongate supports.

In a third separate aspect of the present invention, a mounting for sheet signage on a vehicle is contemplated. A base includes frame elements with a flat side spanning across the frame elements, defining the side of a truck. Two elongate supports retain the mounted sheet and are in turn mounted to frame elements of the side surface of the vehicle only through longitudinal displacement between the base and the supports.

In a fourth separate aspect of the present invention, any of the foregoing separate aspects are contemplated to be combined to greater advantage.

Accordingly, if is an object of the present invention to provide an improved mounting for sheet signage or simple coverage. Other and further objects and advantages will appear hereinafter.

DETAILED DESCRIPTION OF THE PREFERRED EMBODIMENTS

Figure 1:
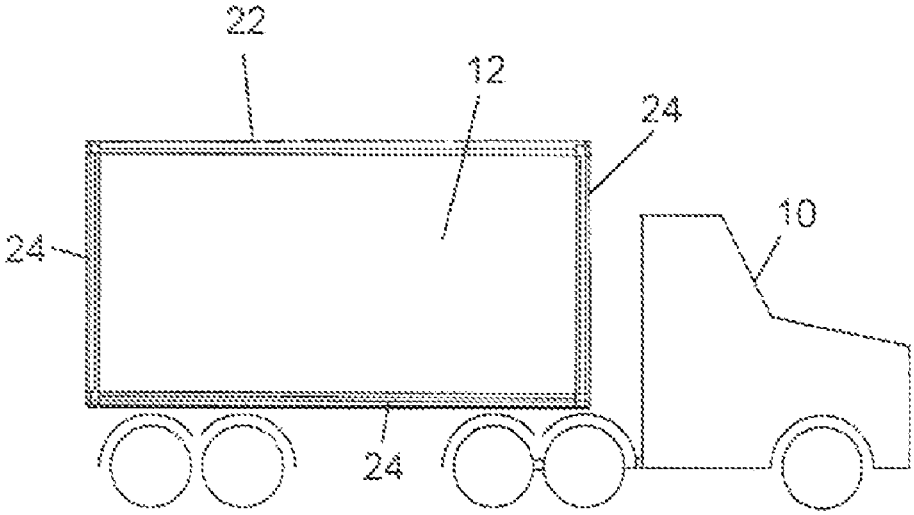
FIG. 1 is the side view of a vehicle employing a mounting for sheet signage.

Turning in detail to the Figures, a truck 10 is illustrated in FIG. 1 and provides a mounting for sheet. The mounting is affixed to the side panel of the truck 10.

Figure 2:
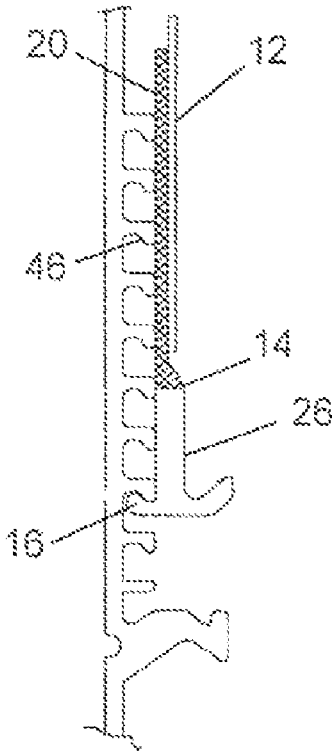
FIG. 2 is an edge view of a first sheet attachment mechanism.

A sheet 12 is mounted to the panel about its periphery. The sheet 12 is contemplated to be vinyl which may be printed upon and tensioned when mounted. The sheet 12 is finished with a peripheral boundary defined by an engaging strip 14 heat welded, sonically welded, sewn, glued or otherwise affixed to the sheet 12. In FIG. 2, the engaging strip 14 has a interlocking flange 16 as the peripheral bead while in FIG. 3, the engaging strip 14 has a bead 18. The engaging strip 14 in both cases also includes an attachment plate 20 attached to the sheet 12 about its periphery.

In FIG. 1, there are two sets of opposed attachments, horizontal systems to engage the top and bottom edges of the sheet 12 and vertical systems to engage the side edges of the sheet 12. Typically one edge of the sheet 12 is engaged by a system 22 without adjustment while the three remaining edges employ systems 24 which can allow for tensioning in the mounting thereof. In this way, a simple capture, typically along the top edge, is accomplished with a fixed mortise. The other edges can then be tensioned to achieve the desired result.

Figure 3:
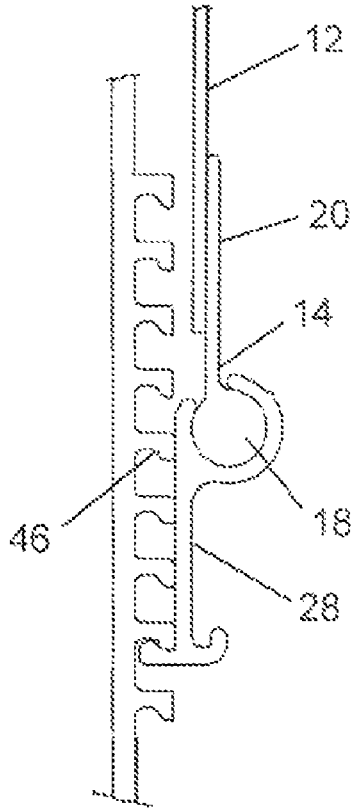
FIG. 3 is an edge view of a second sheet attachment mechanism.

The mechanisms for tensioning and retaining the sheets 12 illustrated in FIGS. 2 and 3 are fully described in U.S. Pat. Nos. 6,278,082; 6,513,272; 6,898,123; 6,782,647; and 6,945,300, the disclosures of which are incorporated herein by reference. In FIG. 2, a retainer 26 is integrated with the engaging strip 14 with a more structural bead 13. In FIG. 3, the retainer 28 is a separate element employing a tenon and mortise mechanism to retain the bead 18.

Figure 4:
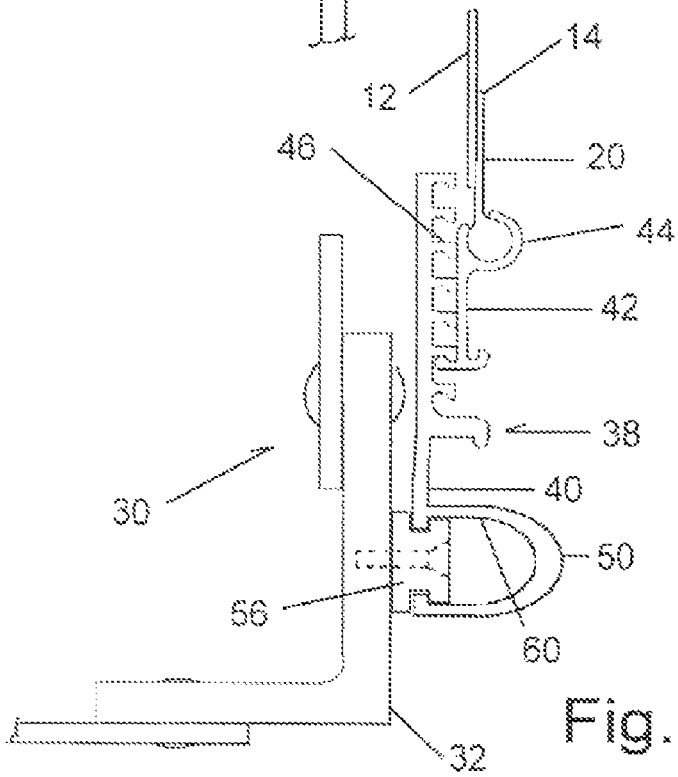
FIG. 4 is an edge view of a first mounting system for sheet signage.

In FIG. 4, a first mounting is illustrated. A base, generally designated 30, is shown as a fragment. This base 30 may be the frame structure of a fixed sign mounting or the frame for a vehicle as illustrated in FIG. 1 defining a side surface of the vehicle. The structure of the base 30 forms a flat supporting surface, shown in this embodiment to be defined by a first elongate frame element 32, a second elongate frame element 34 and a flat side 36 spanning across the flat supporting surface between the first and second elongate frame elements 32, 34. As can be seen from the figures, the flat supporting surface is not smoothly flat because of material thickness and may also exhibit some curvature in the overall surface.

In the embodiment of FIG. 4, a first elongate support, generally designated 38, is shown to include a first frame member 40 and a retainer 42. A first sheet attachment 44 is shown to be associated with the retainer 42. The retainer 42 is engageable with the first frame member 40 on parallel engagement flanges 46 to effect a tensioning of an associated sheet 12. The first elongate support 40 includes a bumper body 50 which extends outwardly of the associated mounting mechanism so as to protect same. Such a body 50 is optional. The first frame member 40 and the retainer 42 are extruded components and have a uniform cross section along their lengths. Both components 40, 42 may extend the full length of the frame or be a subset of a number of such elements arranged serially to cover the full distance of the frame.

A second elongate support, generally designated 52, is illustrated in the embodiment of FIG. 4 displaced from the first elongate support 38 and includes a second sheet attachment 54. The second elongate support 52 is also extruded and has a uniform cross section alone its length. Further, the second elongate support may be composed of a number of serially positioned identical elements to span the frame.

In the embodiment of FIG. 4, the base 30 is illustrated as including two T-rails 56, 58. These T-rails 56, 58 are fastened or otherwise affixed to the first and second elongate frame elements 32, 34, respectively. These rails 56, 58 are also preferably extruded and have a uniform cross section but for the accommodation of the fasteners. Again, the T-rails 56, 58 can span the width of the frame or be presented as identical elongate elements which together span the width of the frame.

Figure 5:
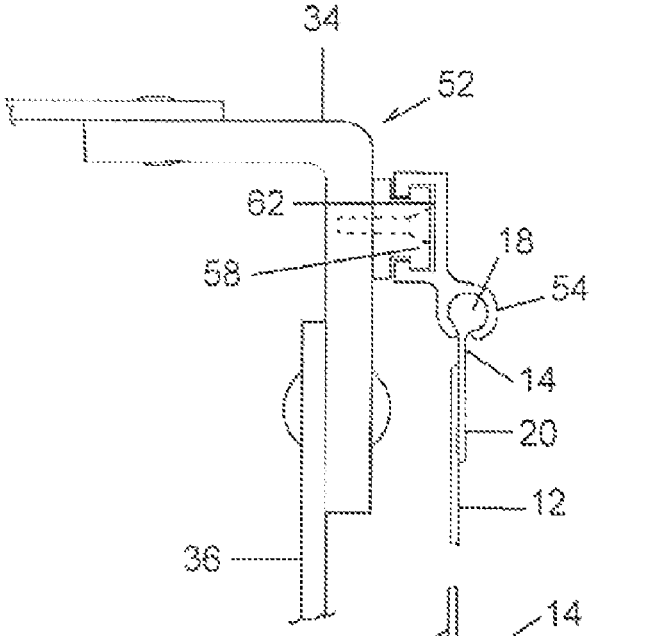
FIG. 5 is a plan view of a corner piece for part of a mount for the system of FIG. 4.
Figure 5:
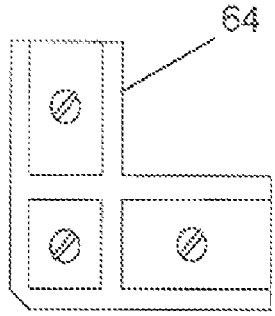

The first elongate support 38 and the second elongate support 52 each include a T-channel 60, 62 to form a mount with the corresponding T-rail 56, 58 having interlocking elements which defines an elongate interlocking channel and rail joint. The engagement of these elements is accomplished through relative longitudinal displacement of the T-channels 60, 62 onto the T-rails 56, 58. The elements are neither engageable nor disengageable through relative lateral displacement. A lock, such as a bolt (not shown), can be easily placed and fastened at either end of the T-channels 60, 62 to prevent disengagement longitudinally as well. FIG. 5 illustrates a corner piece 64 which may be employed between horizontal and vertical T-rails to assist in receiving the T-channels 60, 62. Looking at the end of either leg of the corner pieces 64, the same cross section as that of the T-rails 56, 58 is observed.

Figure 6:
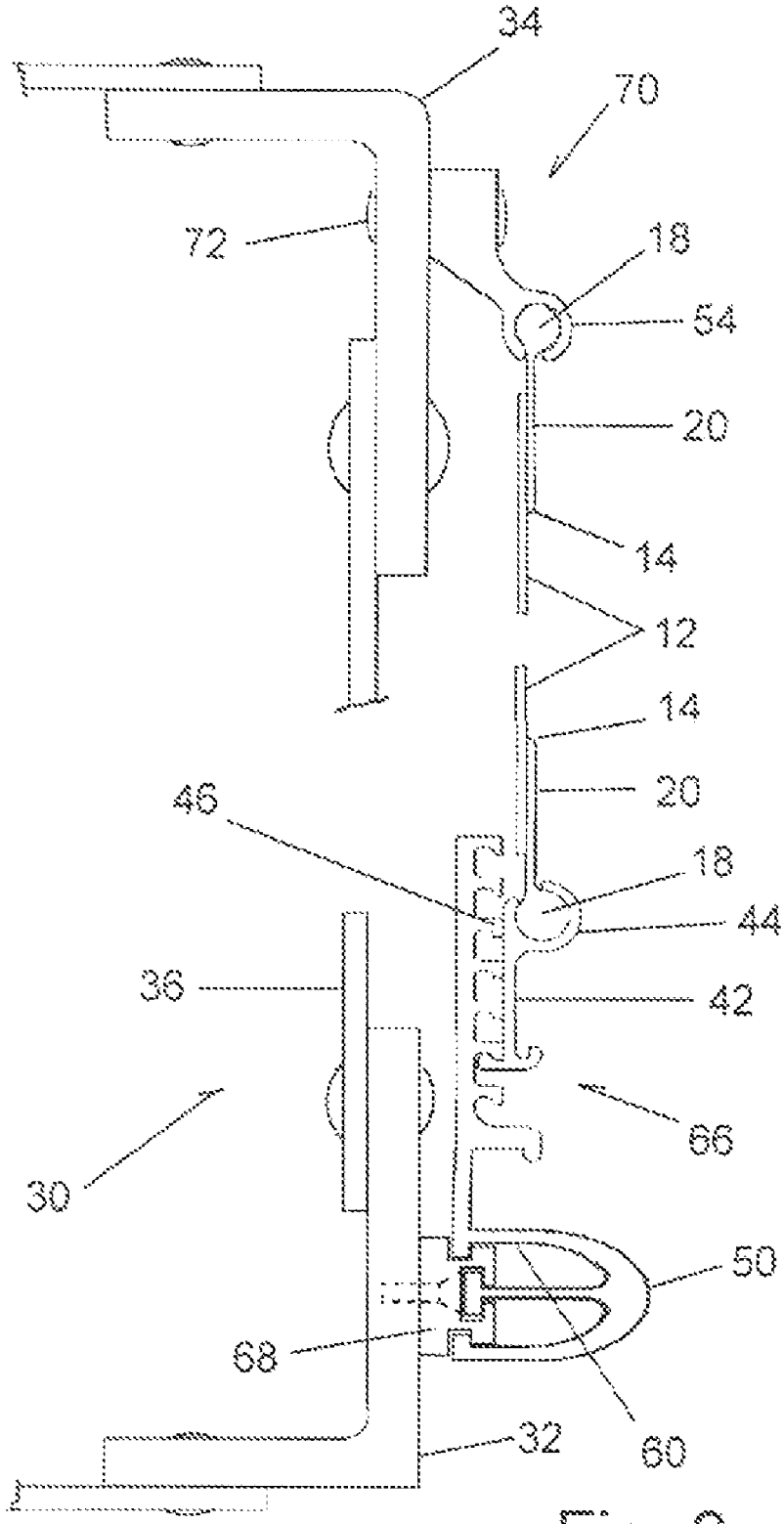
FIG. 6 is an edge view of a second mounting system for sheet signage.

A second embodiment is illustrated in FIG. 6. The reference numerals are employed from the embodiment of FIG. 4 for like components. A first elongate support, generally designated 66, is shown to employ both a T-channel and a superimposed T-rail configuration. The base 30 correspondingly includes a T-channel/T-rail elongate element 68 to interlock and engage the first elongate support 66. A second elongate support, generally designated 70, is shown fixed by a fastener 72 to the second elongate frame element 34.

Figure 7:
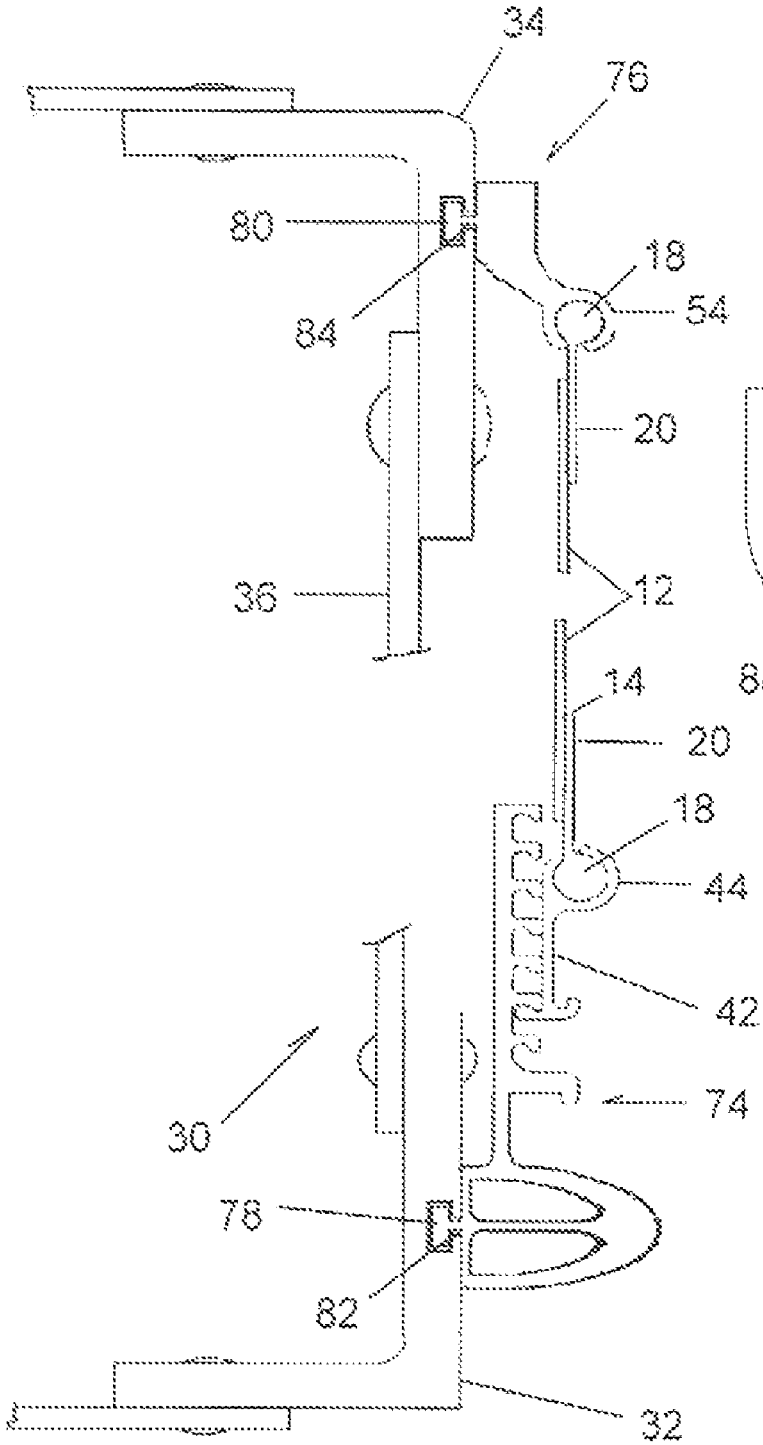
FIG. 7 is an edge view of a third mounting system for sheet signage.
Figure 8:
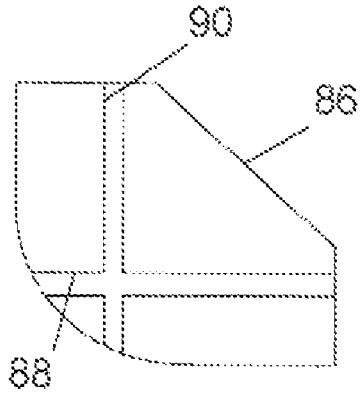
FIG. 8 is a plan view of a corner piece associated with the mounting system of FIG. 7.

FIGS. 7 and 8 illustrate a third embodiment of the present invention, also incorporating common reference numerals as before, in this embodiment the first elongate support, generally designated 74, and the second elongate support, generally designated 78, are shown to include T-rails 78, 80 to interlock with T-channels 82, 84, respectively. The T-rails 78, 80 and the T-channels 82, 84 may be reversed with the mount defined by rails on the base 30 and channels in the elongate supports 74, 76. This embodiment incorporates the concept that the truck, trailer or sign manufacturer is involved in the preparation for the mounting. FIG. 8 illustrates a corner element 86 with T-channels 88, 90 cut therein that would align with the frame elements 32, 34.

Figure 9:
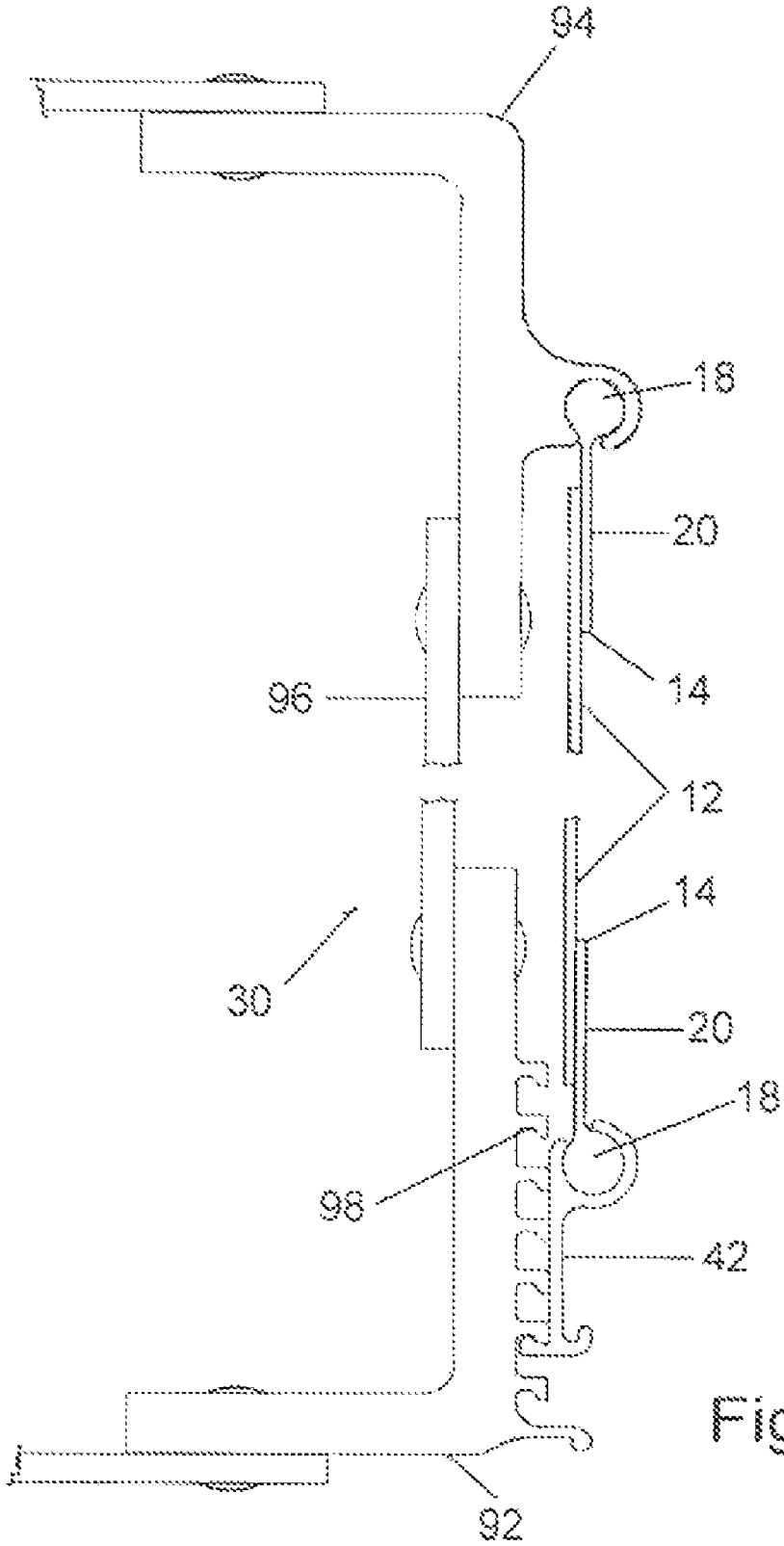
FIG. 9 is a cross-sectional edge view of a further mounting system for sheet signage.

FIG. 9 is yet another embodiment which integrates a portion of a first elongate supped info a first elongate frame element 92 and a second elongate support into a second elongate frame element 94. These elements 92, 94 include a first side lying in the defined flat supporting surface made up of the frame elements 92, 94 and a flat side 96. Parallel engagement flanges 98 extend from the defined flat supporting surface to engage a retainer 42 adjustably to tension the associated sheet 12.

The foregoing separate embodiments which have been illustrated show a variety of mechanisms for mounting the elongate supports to the elongate frame elements. It is contemplated, and here taught, that the various mechanisms of the several embodiments may be employed interchangeably at one or both of the displaced elongate supports.

In operation, the embodiments of FIGS. 4 and 6 require an assembly of the base 30 to include T-rails, T-channels or a combination of both. Such elements may be fastened or otherwise affixed to the elongate frame elements of the vehicle or sign structure. With these devices in place, the elongate supports can be assembled through longitudinal engagement with these T-structures and a mechanism employed to block or otherwise lock the components in place together. Such a mechanism may be as basic as a bolt threaded into the T-structures in the longitudinal path of motion of the elongate supports.

In the device of FIG. 7, specific cooperation with the manufacturer of the supporting frame, be it vehicle or sign structure, is undertaken through the integration of the T-structures of the base into the supporting frame structure. Again, longitudinal engagement of the components results in an assembly of the sheet mounting system.

FIG. 9 further integrates the manufacture of frame structures with the mounting system through the integral fabrication of extruded components defining both frame elements and elongate supports for sheet mounting.

Thus, an improved system for mounting sheet material to a structure is disclosed with particular emphasis on the facile mounting of the mounting system to the structure. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A mounting for sheet signage on a vehicle, the sheet signage having a sheet defining a periphery with at least two opposed edges, the mounting comprising a base including a first frame element and a second frame element displaced from the first frame element, the first frame element and the second frame element defining a side structure of the vehicle;

a first elongate support including a first sheet attachment to retain one of the two opposed edges of the sheet and a first frame member, the first sheet attachment having a retainer engageable with the one of the two opposed edges of the sheet, the retainer being engageable with the first frame member with the first frame member between the retainer and the base;

a second elongate support displaced from the first elongate support and including a second sheet attachment to retain the other of the two opposed edges of the sheet; and a mount on the base, on the first frame member, the mount including interlocking elements engageable through relative longitudinal displacement between the first frame member and the first frame element, and neither engageable nor disengageable through relative lateral displacement between the first frame member and the first frame element, the interlocking elements defining interlocking channel and rail joints at the first frame member, the joint having at least one channel and one rail.

2. The mounting of claim 1, the channels being on the first elongate support.

3. The mounting of claim 1, the rail being on the first elongate support.

4. The vehicle of claim 3, the at least one channel being recessed in the first frame element.

5. The vehicle of claim 4, the channels being a T-channel and the at least one rail being a T-rail.

6. The mounting of claim 1, each of the channels being a T-channel and each of the rails being a T-rail.

7. The mounting of claim 1, the first elongate support includes an elongate interlocking channel and rail joint having two channels and two rails with one rail being on the mount and one rail being on the first elongate frame member, the rails coupling with the channels, respectively, when the first elongate frame member is engaged with the base.

8. The mounting of claim 1, the first elongate support further including a bumper body extending outwardly from the base father than the first sheet attachment.

9. The vehicle of claim 1, one of the first frame member and the first sheet attachment further including engagement surfaces facing away from the second elongate support and the other of the first frame member and the first sheet attachment further including an interlocking surface laterally positionable in interlocking engagement with any one of the engagement surfaces, the engagement surfaces or the interlocking surface on the first frame member extending outwardly away from the base.

* * * * *